US006857905B2

(12) United States Patent
Shieh

(10) Patent No.: US 6,857,905 B2
(45) Date of Patent: Feb. 22, 2005

(54) LAMP SOCKET DEVICE FOR TWINKLE LIGHT BULB

(76) Inventor: Whiter Shieh, 6F, No. 245, Tun Hua South Road, Sec. 1, Taipei (TW), 106

( * ) Notice: Subject to any disclaimer, the term of this patent is extended or adjusted under 35 U.S.C. 154(b) by 6 days.

(21) Appl. No.: 10/426,808

(22) Filed: May 1, 2003

(65) Prior Publication Data

US 2004/0198088 A1 Oct. 7, 2004

(51) Int. Cl.[7] ..... H01K 1/00
(52) U.S. Cl. ..... 439/619; 313/318.01
(58) Field of Search ..... 439/619, 699.2, 439/488, 491

(56) References Cited

U.S. PATENT DOCUMENTS 5,556,287 A * 9/1996 Kuhn et al. ..... 439/89
6,142,646 A * 11/2000 Liu ..... 362/226
6,234,829 B1 * 5/2001 Thomsen ..... 439/488
6,361,368 B1 * 3/2002 Tseng ..... 439/619
6,376,974 B1 * 4/2002 Tsai ..... 313/318.01

* cited by examiner

*Primary Examiner*—Gary Paumen
(74) *Attorney, Agent, or Firm*—Rosenberg, Klein & Lee

(57) ABSTRACT

A lamp socket device includes a polygonal fitting hole for fitting of a twinkle light bulb. The twinkle light bulb includes a lamp base having polygonal configuration in corresponding to the fitting hole. When the twinkle light bulb is fitted to the lamp socket device, two conductive wires of the twinkle light bulb extending from a lower end of a base section of the twinkle light bulb contact the metal plates embedded in the inner wall of the fitting hole to conduct electricity. The fitting hole can be of rectangular, ladder, hexagonal, triangular or any shape that allows the smooth and fast fitting of twinkle light bulb.

7 Claims, 8 Drawing Sheets

LAMP SOCKET DEVICE FOR TWINKLE LIGHT BULB

BACKGROUND OF THE INVENTION

1. Field of the Invention

The present invention relates to a lamp holder structure for lamp of Christmas light string, and more particularly relates to a lamp socket device configured with special fitting hole for fitting of a twinkle light bulb.

2. Description of the Prior Art

A prior art Christmas light string is comprised of a series of regular lamps which are electrically connected to an electric power source via two wires. FIG. 1 is the exploded view showing a prior art lamp 1 is mounted on a lamp base 2, and then received in a fitting hole 31 of a regular lamp holder 3. The lamp 1 includes two conductive wires 11, 12 which are extended from the bottom end of the lamp base 2. The regular lamp holder 3 includes a circular top open end. Two metal plates are embedded in the corresponding inner wall of the lamp holder 3, which are respectively connected with two conductive wire 41, 42 for connection to the light string. The lamp 1 with the lamp base 2 is mounted into the fitting hole 31 of the lamp holder 5.

To create flashing effect, at least one flashing lamp is electrically connected with a series of regular lamps. Conventionally, a flashing lamp includes two conductive poles which are connected with exterior conductive wires. A bimetal plate is connected between two ends of the conductive poles. When the conductive poles are supplied with an electric power source, the bimetal plate is heated. After a predetermined time is reached, the heated bimetal plate bends. The connection between the two conductive poles and hence the electric current flow through the conductive poles are cut off. Subsequently, the lamp is not heated and is cooled down. After the lamp has cooled to a predetermined temperature, the bimetal plate will return to the original state and connection between the two conductive poles is restored. Thereby, the illumination of the light string is controlled by the heating state of the bimetal plate in the flashing lamp.

However, this prior art Christmas light string only provide a monotonous flashing effect. Although a plurality of light strings can be connected in parallel to enhance the flashing effect, the flicking patterns are limited and monotonous.

In another prior art, a plurality of light strings are connected in parallel, each of which comprises an appropriate number of twinkle lamps connecting to a series of regular lamps. By means of the twinkle lamps, various flickering patterns are created.

Anyway, in designing the parallelly connected bulb strings, designer should be cautious of the number of twinkle lamps used. Improper design of using too many twinkle lamps may cause overloading of electricity to regular lamps which may burn at the instant of flashing of the twinkle lamps. Such a catastrophe also happens when twinkle lamp is mistakenly mounted to the lamp holder of regular lamp.

Therefore, it is necessary to provide a lamp socket device with fitting hole particularly configured for Christmas flashing lamp which processes corresponding configuration for fitting into the fitting hole. By this mean, it is not able to fit the Christmas flashing lamp into the lamp holder for regular lamp.

SUMMARY OF THE INVENTION

Accordingly, a primary object of the present invention is to provide a lamp socket device configured with special fitting hole for fitting of lamp base with corresponding configuration. By this mean, only the twinkle light bulb processes the lamp base with corresponding configuration can be mounted to the lamp socket device.

Another object of the present invention is to provide a light string with a lamp socket device having an external shape and dimension identical to the lamp holder of regular lamp. With the mounting of lamp or bulb, the external appearances of regular lamp and twinkle light bulb are the same. When a plurality of regular lamps and twinkle light bulbs are connected to form a light string, they are not distinguishable from each other from the exterior. It provides the light string a neat and beautiful appearance.

BRIEF DESCRIPTION OF THE DRAWINGS

The present invention will be better understood and its numerous objects and advantages will become apparent to those skilled in the art by referencing to the following drawings in which.

DETAILED DESCRIPTION OF THE PREFERRED EMBODIMENTS

The present invention comprises a twinkle light bulb which is mounted to a lamp socket device with a polygonal fitting hole. The twinkle light bulb comprises a lamp base that has a polygonal configuration corresponding to the fitting hole and is able to fit into the fitting hole. When the twinkle light bulb with the lamp base is fitted into the lamp socket device, the two conductive wires of the twinkle light bulb contact with the two metal plates embedded in the inner wall of the fitting hole to conduct electricity.

Figure 2:
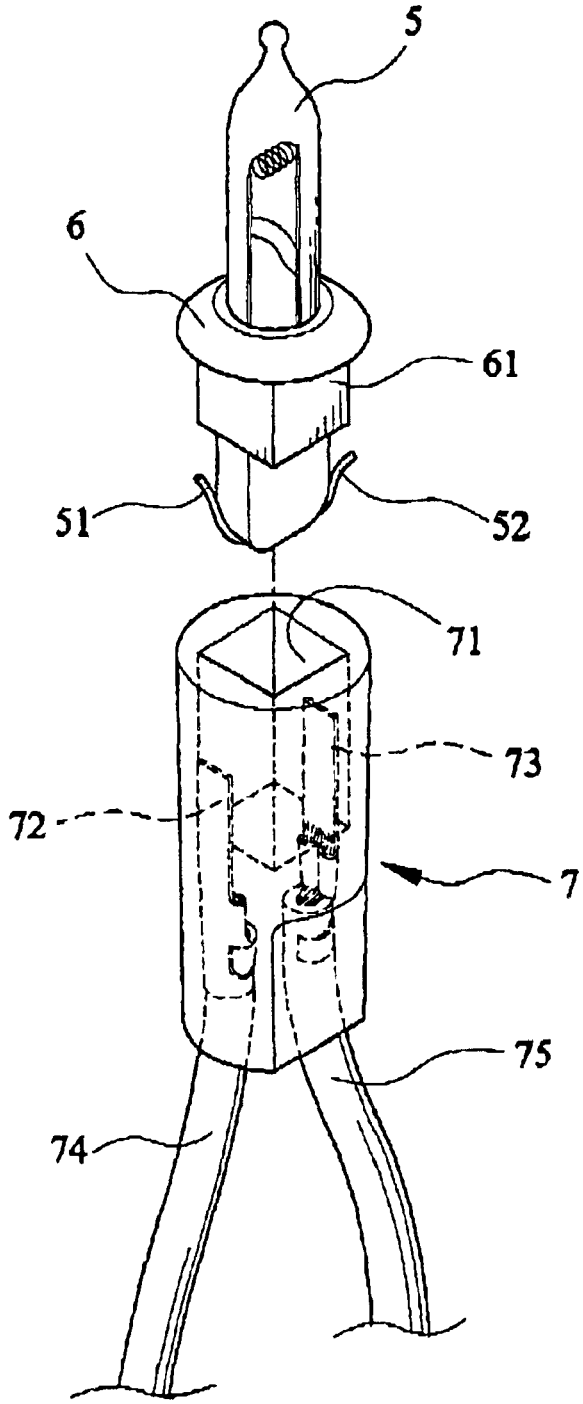
FIG. 2 is an exploded view of a lamp socket device in accordance with a first embodiment of the present invention, showing a twinkle light bulb with a lamp base to be mounted to a fitting hole of a lamp socket device.
Figure 3:
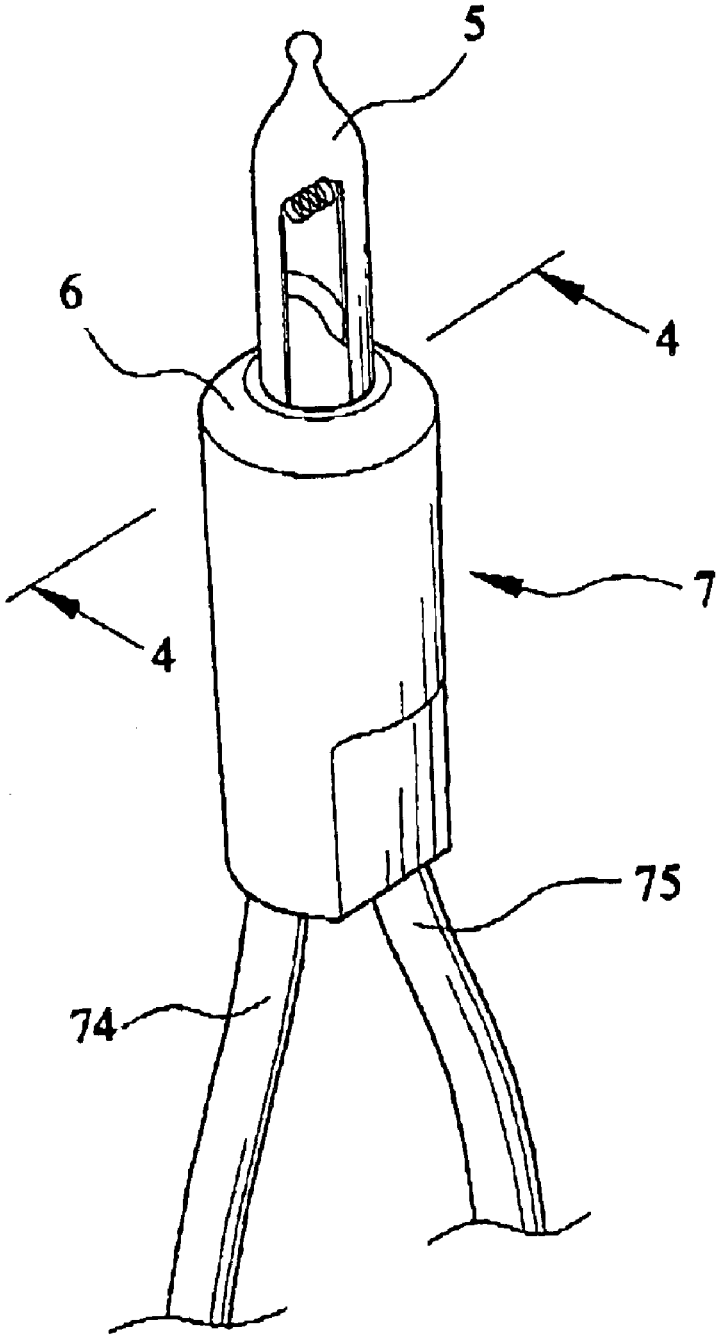
FIG. 3 is a perspective view showing the mounting of the twinkle light bulb with a lamp base to the lamp socket device.

With reference to the drawings and particular to FIG. 2, a twinkle light bulb 5 is first fitted into a lamp base 6. The lamp base is configured to have a cubic base section 61 with two conductive wires 51, 52 extending from the two corresponding sides of the base section 61, As shown, the twinkle light bulb 5 is mounted to and adhered to the lamp base 6 with adhesive material to secure anchorage to the lamp base 6.

Figure 4:
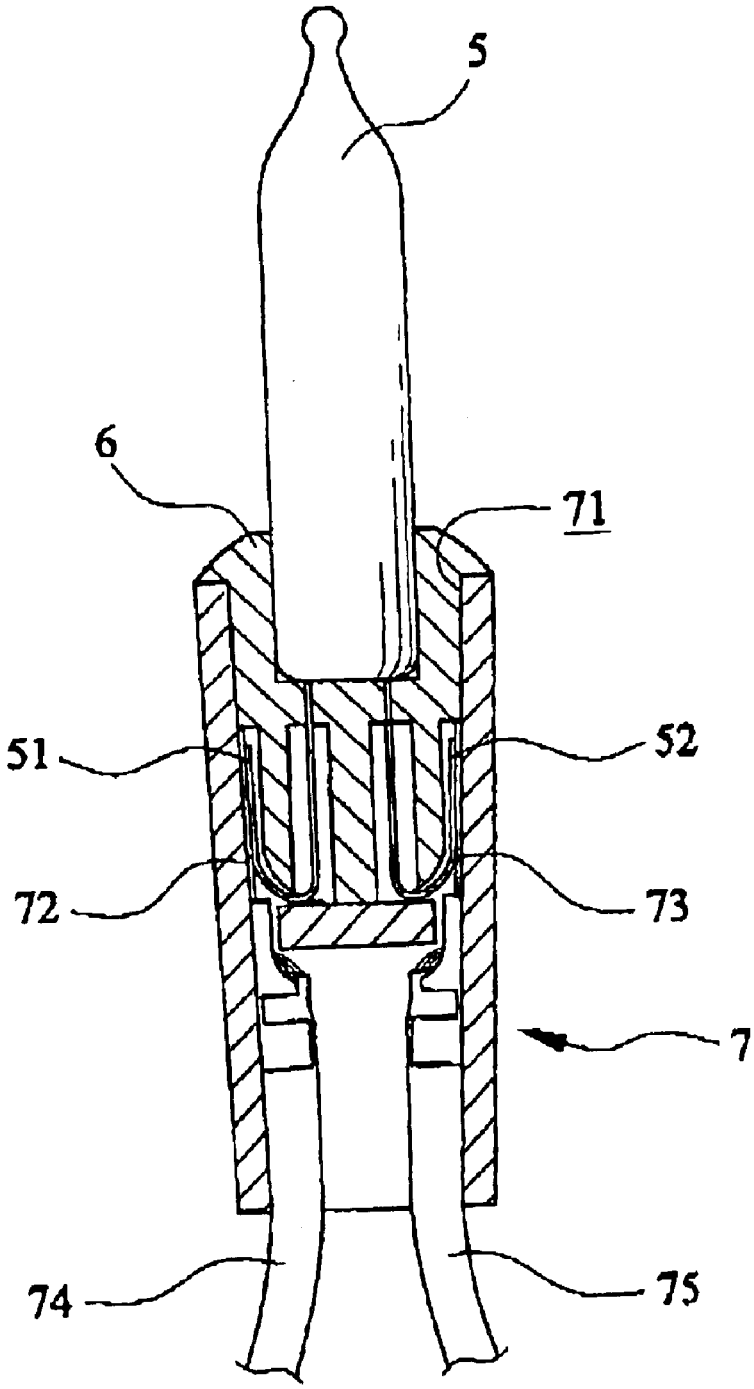
FIG. 4 is a sectional view along line 4—4 of FIG. 3.

A lamp socket device 7 comprises a rectangular fitting hole 71 with a top open end. The configuration of the fitting hole 71 corresponds to the cubic base section 61 of lamp base 6. Please also refer to FIG. 4. Two metal plates 72, 73 are respectively embedded to the two corresponding sides of the inner wall of the fitting hole 71, The metal plates 72, 73 are respectively connected with two conductive wires 74, 75 which passing through the base of the lamp socket device 7.

Accordingly, when the twinkle light bulb 5 is fitted to the lamp base 6 which is then fitted into the fitting hole 71 of the twinkle socket device 7, the two conductive wires 51, 52 of twinkle light bulb 5 respectively contact with the metal plates 72, 73 to conduct electricity.

Figure 1:
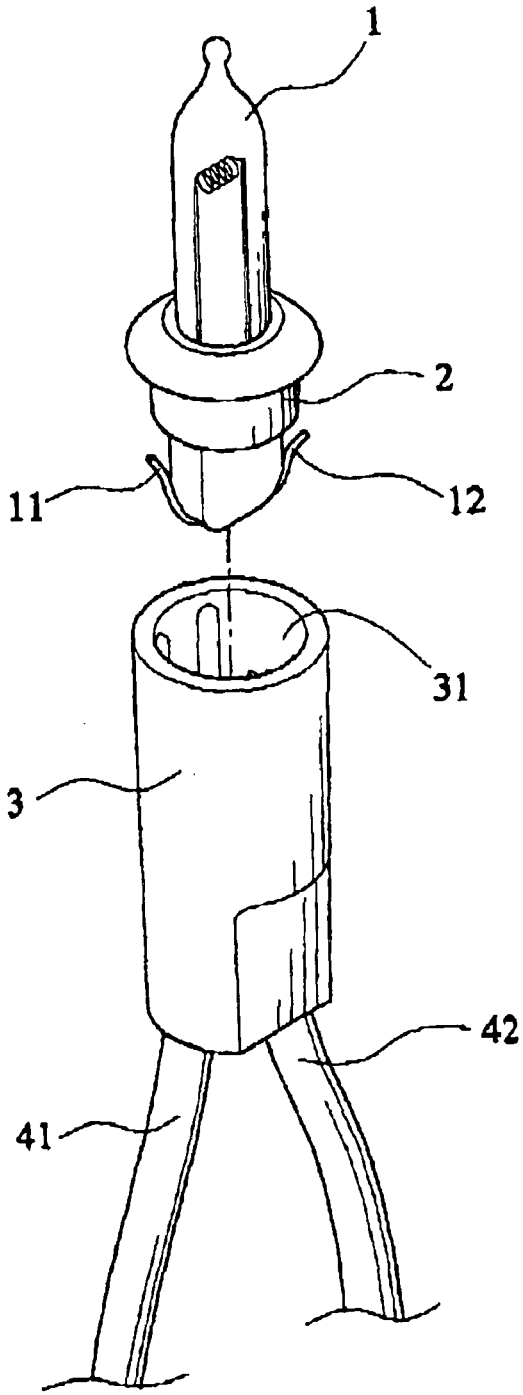
FIG.1(PRIOR ART)
FIG. 1 is an exploded view showing a regular lamp with a lamp base to be mounted on a regular lamp holder.

Thereby, user can simply recognize from the exterior of lamp holder the type of lamp that the lamp holder can serve. The lamp holder with round fitting hole 31 as shown in FIG. 1 is for fitting of regular lamp, while the lamp holder with a rectangular fitting hole 71 is for fitting of twinkle light bulb, Therefore, it can ensure the mounting of a proper type of lamp to a lamp holder, especially when assembling a plurality of twinkle light bulbs and regular lamps to a light string at the same time.

Preferably, the lamp socket device for twinkle light bulb can be dyed with suitable color or marks for enhancing visual recognition.

Figure 5:
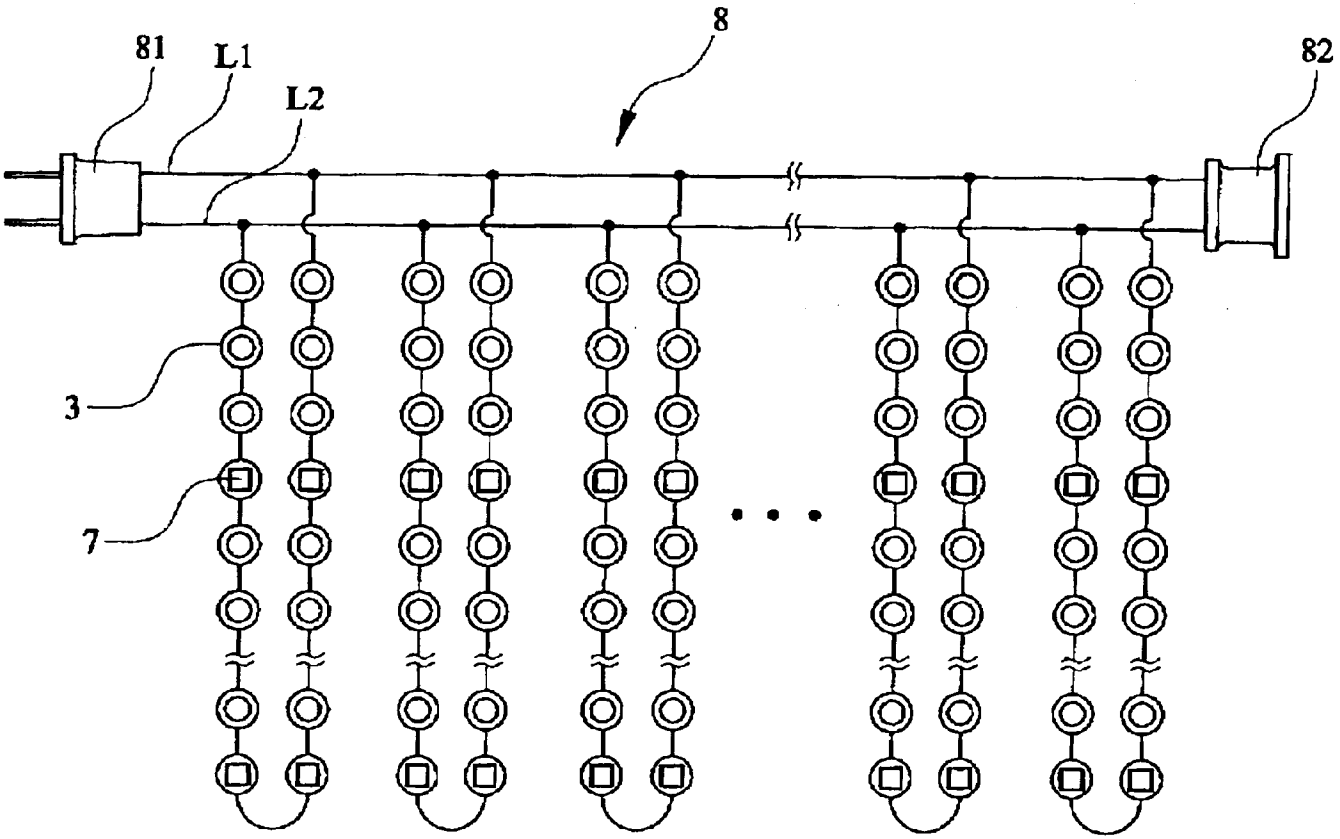
FIG. 5 is schematic circuit diagram of a plurality of light strings, which comprises an appropriate number of twinkle light bulbs of the present invention and a series of regular bulbs, electrically connected in parallel to two wires.

FIG. 5 is a schematic circuit diagram showing a plurality of light strings are connected in parallel to form a light string assembly 8. The two ends of each light string are respectively electrically connected to two wires L1, L2. One end of each wire L1, L2 is connected to a plug 81, and the other end of the wire L1, L2 is connected to an extended plug 82. Each of the light string comprises an appropriate number of twinkle light bulbs 7 and a plurality of regular lamps 3. For example, one twinkle light bulb 7 is arranged for every three regular lamps 7.

Figure 6:
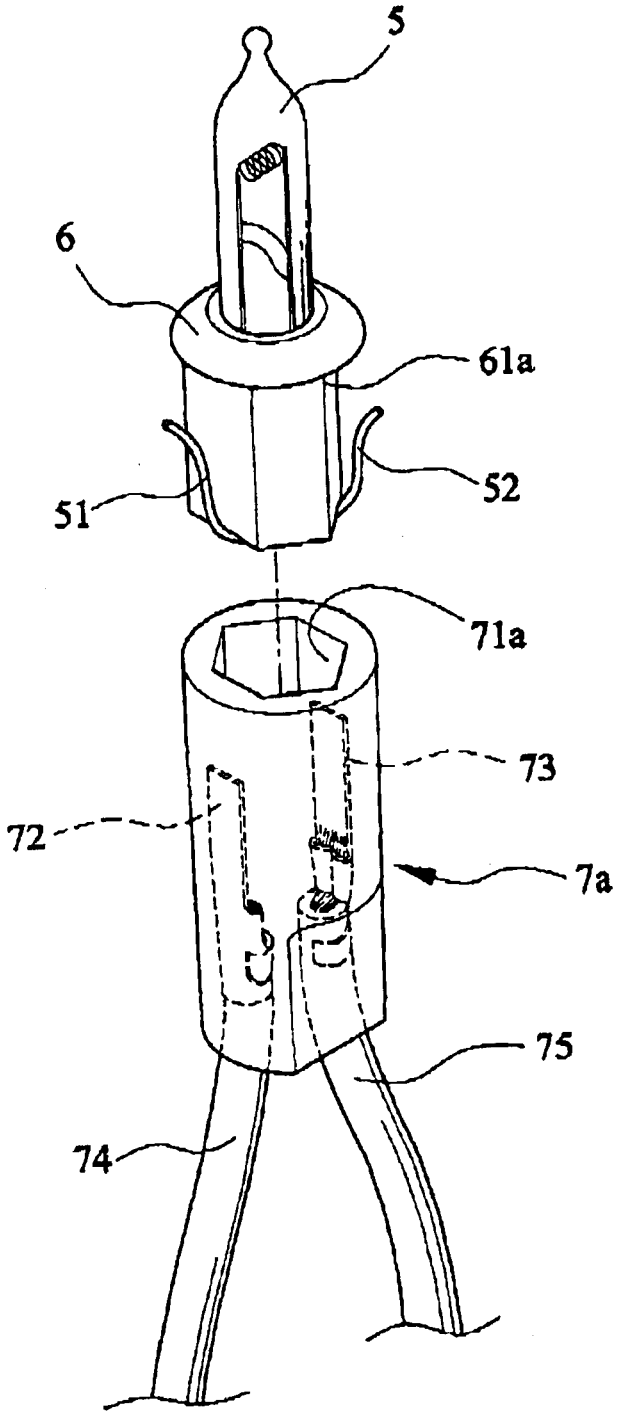
FIG. 6 is an exploded view of a lamp socket device in accordance with a second embodiment of the present invention, showing a twinkle light bulb with a lamp base to be mounted to the fitting hole of the lamp socket device.

FIG. 6 is an exploded view showing a second embodiment of the lamp socket device in accordance with the present invention which is designated with reference numeral 7*a* for distinction. The lamp socket device 7*a* is substantially identical to that shown in FIG. 2, except that the fitting hole 71*a* is of hexagonal shape and the base section 61*a* of lamp base 6 has the corresponding hexagonal configuration.

Figure 7:
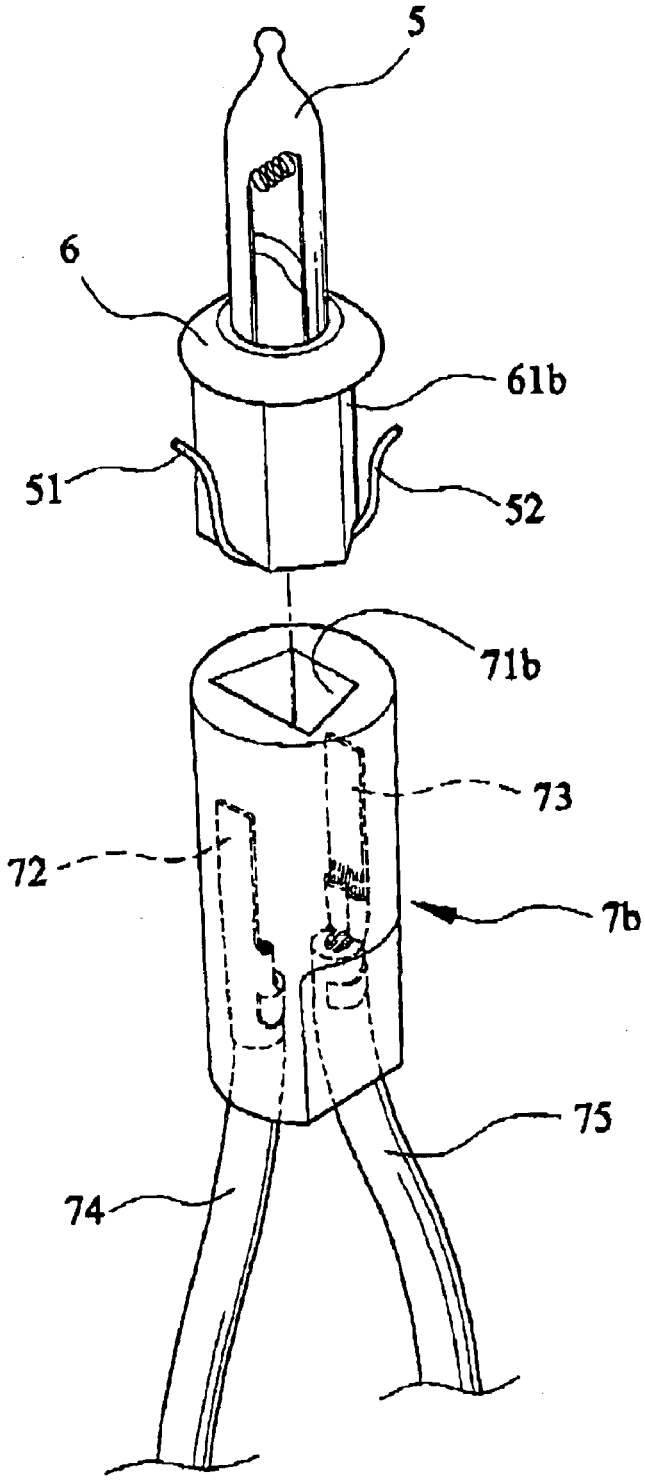
FIG. 7 is an exploded view of a lamp socket device in accordance with a third embodiment of the present invention, showing a twinkle light bulb with a lamp base to be mounted to a fitting hole of the lamp socket device.

FIG. 7 is an exploded view showing a third embodiment of the lamp socket device in accordance with the present invention which is designated with reference numeral 7*b* for distinction. The lamp socket device 7*b* is substantially identical to that shown in FIG. 2, except that the fitting hole 71*b* is ladder-shaped and the base section 61*b* of lamp base 6 has the corresponding ladder-shaped configuration.

Figure 8:
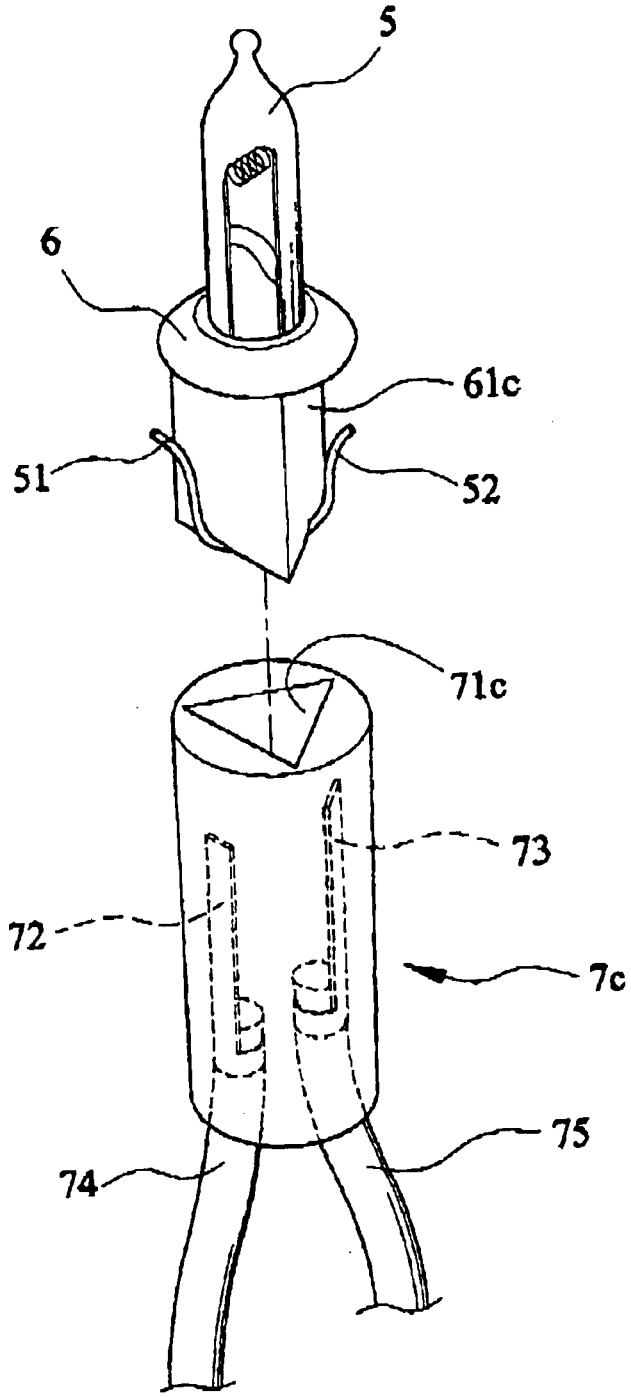
FIG. 8 is an exploded view of a lamp socket device in accordance with a fourth embodiment of the present invention, showing a twinkle light bulb with a lamp base to be mounted to the fitting hole of the lamp socket device.

FIG. 8 is an exploded view showing a fourth embodiment of the lamp socket device in accordance with the present invention which is designated with reference numeral 7*c* for distinction. The lamp socket device 7*c* is substantially identical to that shown in FIG. 2, except that the fitting hole 71*c* is triangular shape and the base section 61*c* of lamp base 6 has the corresponding triangular shape configuration.

Accordingly, light string which is formed with an appropriate number of twinkle light bulbs are connected with a plurality of regular lamps can provide a brilliant flickering effect. In the assembling or replacement of light bulbs, user can easily recognize and determine from the lamp holder whether regular lamp or twinkle light bulb should be mounted. Therefore, overloading resulted from mistaken mounting of light bulb can be prevented.

It is to be understood that the above description and drawings are only used for illustrating some embodiments of the present invention, not intended to limit the scope thereof. Any variation and derivation from the above description and drawings should be included in the scope of the present invention.

What is claimed is:

1. A lamp socket device and twinkle light bulb comprising:

the twinkle light bulb, which comprises a lamp base with a polygonal configuration, two conductive wires of the twinkle light bulb extending out of a lower end of a base section of the lamp base;

a lamp socket device formed with a fitting hole having a polygonal mouth at an upper terminal end thereof, the fitting hole being defined by a plurality of inner walls to be polygonal in sectional contour for receiving the lamp base therein; and at least two metal plates being arranged on the inner walls of the fitting hole; wherein when the lamp base is fitted into the lamp socket device, the two conductive wires of the twinkle light bulb respectively contacts the metal plates.

2. The lamp socket device and twinkle light bulb as claimed in claim 1, where the fitting hole of the lamp socket device is rectangular shape, and the base section of the lamp base of twinkle light bulb has the corresponding rectangular configuration.

3. The lamp socket device and twinkle light bulb as claimed in claim 1, where the twinkle light bulb is mounted to and adhered to the lamp base with adhesive material to secure anchorage to the lamp base.

4. The lamp socket device and twinkle light bulb as claimed in claim 1, where the lamp base and lamp socket device are dyed with color or marks for enhancing visual recognition.

5. A lamp socket device and twinkle light bulb comprising:

the twinkle light bulb, which comprises a lamp base with a polygonal configuration, two conductive wires of the twinkle light bulb extending out of a lower end of a base section of the lamp base;

a lamp socket device formed having a polygonal mouth at an upper terminal end thereof, the fitting hole being defined by a fitting hole with a plurality of inner walls of polygonal configuration corresponding to the lamp base; and at least two metal plates being arranged on the inner walls of the fitting hole; wherein when the lamp base is fitted into the lamp socket device, the two conductive wires of the twinkle light bulb respectively contacts the metal plates;

where the fitting hole of the lamp socket device is trapezoid-shaped, and the base section of the lamp base of twinkle light bulb has the corresponding trapezoid-shaped configuration.

6. A lamp socket device and twinkle light bulb comprising:

the twinkle light bulb, which comprises a lamp base with a polygonal configuration, two conductive wires of the twinkle light bulb extending out of a lower end of a base section of the lamp base;

a lamp socket device formed having a polygonal mouth at an upper terminal end thereof, the fitting hole being defined by a fitting hole with a plurality of inner walls of polygonal configuration corresponding to the lamp base; and at least two metal plates being arranged on the inner walls of the fitting hole; wherein when the lamp base is fitted into the lamp socket device, the two conductive wires of the twinkle light bulb respectively contacts the metal plates;

where the fitting hole of the lamp socket device is hexagonal shape, and the base section of the lamp base of twinkle light bulb has the corresponding hexagonal configuration.

7. A lamp socket device and twinkle light bulb, comprising:

the twinkle light bulb, which comprises a lamp base with a polygonal configuration, two conductive wires of the twinkle light bulb extending out of a lower end of a base section of the lamp base;

a lamp socket device formed having a polygonal mouth at an upper terminal end thereof, the fitting hole being defined by a fitting hole with a plurality of inner walls of polygonal configuration corresponding to the lamp base; and at least two metal plates being arranged on the inner walls of the fitting hole; wherein when the lamp base is fitted into the lamp socket device, the two conductive wires of the twinkle light bulb respectively contacts the metal plates;

where the fitting hole of the lamp socket device is triangular shape, and the base section of the lamp base of twinkle light bulb has the corresponding triangular configuration.

* * * * *